United States Patent [19]

Ferrari

[11] 4,408,760

[45] Oct. 11, 1983

[54] STRUNG RACQUET

[76] Inventor: Harry Ferrari, 144 W. Swissvale Ave., Pittsburgh, Pa. 15218

[21] Appl. No.: 319,576

[22] Filed: Nov. 9, 1981

Related U.S. Application Data

[62] Division of Ser. No. 939,481, Sep. 5, 1978, Pat. No. 4,330,132.

[51] Int. Cl.[3] ..... A63B 49/00

[52] U.S. Cl. ..... 273/73 D

[58] Field of Search ..... 273/73 A, 73 D, 73 E, 273/73 C, 73 R

[56] References Cited

U.S. PATENT DOCUMENTS 801,246 10/1905 Johnson ..... 273/73 D 4,131,279 12/1978 Ogden ..... 273/73 D

*Primary Examiner*—Richard C. Pinkham

*Assistant Examiner*—Matthew Schneider

*Attorney, Agent, or Firm*—Hymen Diamond

[57] ABSTRACT

A racquet in which the area of the string which manifests relatively true rebound of the ball, the so-called "sweet spot", is maximized. To achieve this condition the strings are so tensioned or so structured that the deflection produced by impact of the ball near the outer periphery of the racquet is substantially equal to the deflection near the center of the racquet. The strings are subjected to lower tension near the outer periphery than near the center of the racquet or they are of smaller thickness near the outer periphery than near the center or they are differently irradiated. So as to achieve the different tensions with strings of a given diameter, a plurality of separate short string lengths are used.

9 Claims, 5 Drawing Figures

STRUNG RACQUET

REFERENCE TO RELATED APPLICATIONS

This application is a division of application Ser. No. 939,481, filed Sept. 5, 1978 now U.S. Pat. No. 4,330,132, granted May 18, 1982, to Harry Farrari for RACQUETS.

BACKGROUND OF THE INVENTION

This invention relates to stringed racquets for tennis, squash, racquet ball or the like in which in play a racquet strikes a ball. The invention has particular relationship to stringing of the racquets so as to improve the properties of the racquets in play.

Racquets are commonly strung with tensioned string of natural animal gut or synthetic materials or metal wire. The natural gut is made from beef or lamb intestines, and the synthetic materials are made of polymeric materials such as nylon (polyamides or polymeric composites). Natural gut is normally considered to have better playing characteristics; however, it is more costly, affected by weather, and has a short life. Usually a racquet is strung with one continuous length of string (about 33 feet long in the case of a tennis racquet). The string is subject to the same tension, typically of about 55 pounds, throughout. Typically, the string has a diameter of about 0.040 to 0.060 inch. In some cases two separate string lengths may be used as shorter lengths than the 33 feet are more readily manufactured and with shorter lengths stringing is facilitated for some racquets. However, where a racquet is strung with two lengths of string, both are usually subject to the same tension.

An important factor in playing performance is the area of the "sweet spot" or the center section of the racquet which exhibits a relatively true rebound to the ball. It is desirable that this "sweet spot" be of as large as practicable area as balls struck outside of the "sweet spot" do not bounce truely and there is a "fault" when a ball is struck in this outside area. In an attempt to enhance the area of the "sweet spot", stringers have strung racquets so that the strings are diagonal or so that there are missing rows of strings near the top, bottom and sides, i.e., around the periphery of the racquet. Neither of these expedients has been sufficiently successful to receive widespread adoption. Strings have also attempted to string portions of the racquets at different tensions; but, this was not successful because the tensions could not be maintained at the initial desired settings during play.

It is an object of this invention to maximize effectively the area of a racquet which manifests relatively true rebound.

SUMMARY OF THE INVENTION

Computer studies of the manner in which the strings of a prior art racquet responds to impact of the ball during play have revealed that frequent faults or mishits result when the ball is struck by the strings along the periphery of the racquet because the strings in this area are the shortest and deflect less for like impacts of the ball than the strings in the center of the racquet. To maximize the area of the "sweet spot" of a racquet, it is necessary to maximize the area of the racquet over which the strings have substantially the same deflection, regardless of the differences in string lengths, string locations, spacings between strings, etc. In the practice of this invention, a racquet is provided which has independent string lengths throughout the string area. Each string length is composed of string whose properties and/or structures are such as to achieve, and maintain throughout the life of the racquet, substantially equal deflection for like impacts of the ball. As used in this application the expression "string section" means a section of longer string, for example, where a racquet is strung with one or two long strings, a string section means a section less than the whole of a long string. A string section at a given tension may extend between a pair of holes in the frame of the racquet or between a plurality of pairs of holes. As used in this application a "string length" means a length of string separate from other lengths where a racquet is strung with separate short lengths of string. The parent application is directed to a racquet having an enlarged "sweet spot" string with long string lengths subdivided into sections which are maintained at different tensions.

In the practice of this invention a racquet is strung with short string lengths, each threaded through a number of holes and each subject to different tension. Each string length may be threaded through opposite holes of the frame or through a plurality of pairs of opposite holes. The string lengths are threaded through opposite holes in the usual way with one set longitudinally of the racquet from top to bottom along the direction of the handle, like a warp, and the other set transversely of the racquet perpendicular to the handle and interlaced with the longitudinal strings like a woof. In both cases longer string lengths pass across the center of the racquet and shorter string lengths pass across the periphery of the racquet. In each case the tension is substantially higher for the longer string lengths than for the shorter string lengths. The deflection for like impacts by a ball of a string length subject to lower tension is greater than for string lengths subject to higher tension. The tensions are so adjusted in the practice of this invention that the deflection of the shorter string lengths under an impact is substantially the same as the deflection of the longer string lengths for a like impact. It is essential that each string length be securely locked in position by being wedged in one of the holes through which it is threaded. The tension may vary progressively from the highest magnitude near the center of the racquet to the lowest magnitude near the periphery.

The deflection may also be set as described above by providing string lengths of different modulus of elasticity, higher modulus for the string lengths near the center of the racquet and lower modulus for string lengths near the periphery. The modulus of elasticity may be set as desired by appropriate selection of string lengths of different materials such as different amides, graphite composites, etc. The modulus of elasticity may also be varied by irradiation as disclosed in U.S. Pat. No. 4,015,133 Ferrari (Table I—Column 3, line 65).

The deflection may also be set as required by providing string lengths of different cross-sectional area; i.e., usually different diameters as the strings are of circular cross section. The string lengths which pass through the center of the racquet are of greater cross-sectional area than the string lengths around its periphery.

In the practice of this invention strings whose surfaces have a high coefficient of friction, for example, strings with roughened surfaces, may be used. The increased friction would increase the resistance of the strings to movement where the strings cross and also in the holes of the frame. The tension would then remain as set.

BRIEF DESCRIPTION OF THE DRAWING

For a better understanding of this invention, both as to its organization and as to its method of operation, together with additional objects and advantages thereof, reference is made to the following description taken in connection with the accompanying drawings, in which.

DETAILED DESCRIPTION OF EMBODIMENTS

Figure 2:
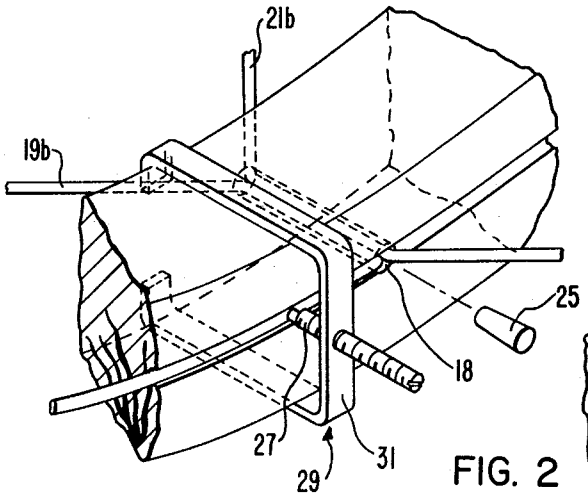
FIG. 2 is a view in perspective showing the manner in which the predetermined tension is maintained temporarily in one of the string lengths threaded through a hole of the frame of the racquet shown in FIG. 1 through which two string lengths are threaded.
Figure 1:
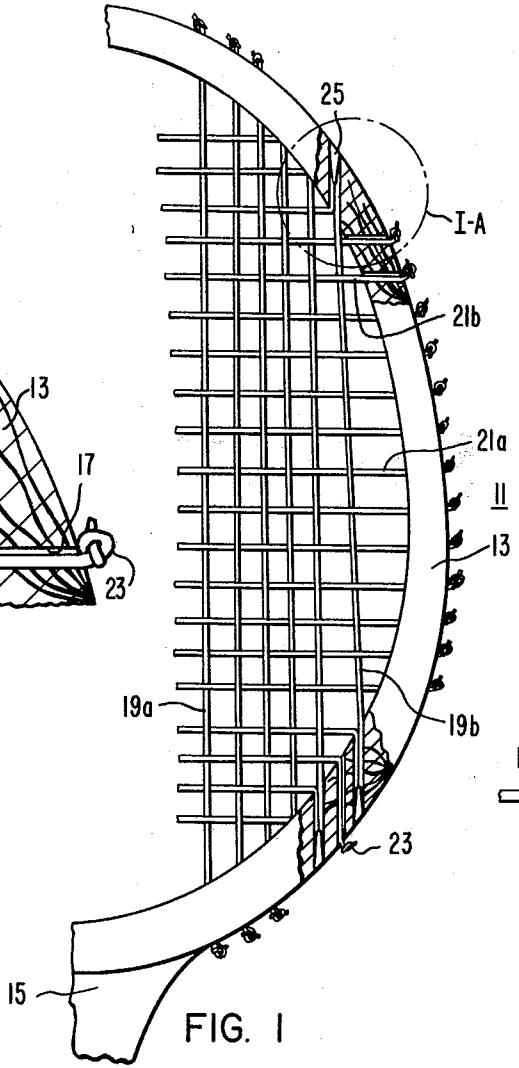
FIG. 1 is a fragmental view in front elevation and partly in section showing a racquet in accordance with this invention formed with separate short string lengths under different tensions.
Figure 1A:
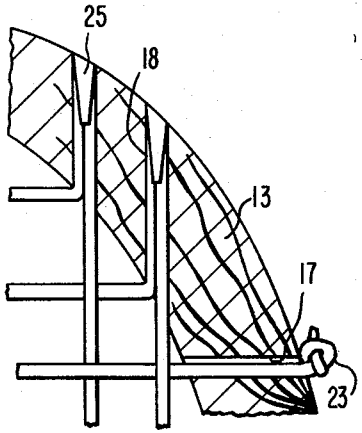
FIG. 1A is a fragmental view in section of the portion of the racquet shown in FIG. 1 in the Circle IA.

The apparatus shown in FIG. 1 is a racquet 11 including a frame 13 and a handle 15. The frame 13 has the conventional holes 17 and 18 (FIG. 1A). Longitudinal separate string lengths 19*a* and 19*b* and transverse separate string lengths 21*a* and 21*b* are threaded through opposite pairs of the holes 17 and 18. The holes 17 accommodate the ends of single string lengths 19*a* or 21*a* and the holes 18 accommodate the ends of two string lengths 19*b* and 21*b*. The string lengths 19*a* are threaded through holes 17 disposed oppositely longitudinally of the racquet 11 across the center portion of the racquet and the string lengths 19*b* are threaded through holes 18 disposed oppositely longitudinally of the racquet 11 near the periphery of the racquet. Each string length 19*a* or 19*b* has a knot 23 at the trailing end which prevents it from being pulled through the adjacent hole 17 or 18. At the leading end each string length is pulled through the opposite hole 17 or 18 and subjected to tension and then locked, where the hole 17 accommodates the leading end of a single string length, or temporarily held in position where the hole 18 accommodates the leading ends of two string lengths. The leading end of the string 19*b* is held by the clamping pin 27 (FIG. 2) of a clamp 29 which is screwed into the frame 31 to hold the leading end tightly. The clamp 29 is displaced from the hole 18 so that the leading end of the other string length 21*b* which passes through the hole 18 may be readily threaded through the hole. Where the leading end of a string length 19*a* is pulled through a single hole 17, it is permanently locked by a tapered plug or wedge 25 after being tensioned. Where a string length, usually 19*b*, is threaded through a hole 18 accommodating the leading ends of two string lengths, it is temporarily held by the clamp.

The string lengths 21*a* extend transversely across the center portion of the racquet 11 and the string lengths 21*b* extend transversely across near the peripheral portions of the racquet. The string lengths 21*a* and 21*b* are threaded through holes 17 and 18 disposed oppositely transversely of the racquet. Each string length 21*a* or 21*b* is knotted at the trailing end to prevent it from being pulled through the trailing hole when tensioned. At the leading end each string length 21*a* or 21*b* is tensioned and locked in the leading hole. Each string length 21*a* which passes through a hole 17 that accommodates the leading end of a single string length is locked by the tapered plug or wedge 25 which is secured in the holes 17. Each string length, usually 21*b*, which passes through a hole 18 that accommodates the ends of two string lengths, is threaded through a hole in which a tensioned longitudinal string length is already being held by the clamp 29. Once string length 21*b* is threaded through hole 18, it is tensioned. While this string length 21*b* is in tension, the plug 25 (FIG. 2) is secured in hole 18 locking the ends of string lengths 19*b* and 21*b* in the hole 18 and clamp 29 is removed.

The string lengths 19*a* and 21*a* near the center portion of the racquet 11 are subjected to higher tension than the string lengths 19*b* and 21*b* near the periphery of the racquet. At the periphery near the transverse center of the racquet 11 the longitudinal string lengths 19*b* are subject to the low tension while the transverse string lengths 21*a* which interlace with these string lengths 19*b* are subject to high tension. Likewise at the periphery near the longitudinal center of the racquet the transverse string lengths 21*b* are subject to lower tension while the longitudinal string lengths 19*a* are subject to high tension. In the quadrant regions displaced about 30° to 60° from the longitudinal and transverse centers and remote from the axis of the racquet both the string lengths 19*b* and 21*b* are subject to lower tensions and near the axis of the racquet both the string lengths 19*a* and 21*a* are subject to higher tensions. The tensions are so set in the racquet shown in FIGS. 1 and 2 that for like impacts of a ball, the deflection of the string is substantially uniform through the face of the racquet.

Figure 3:
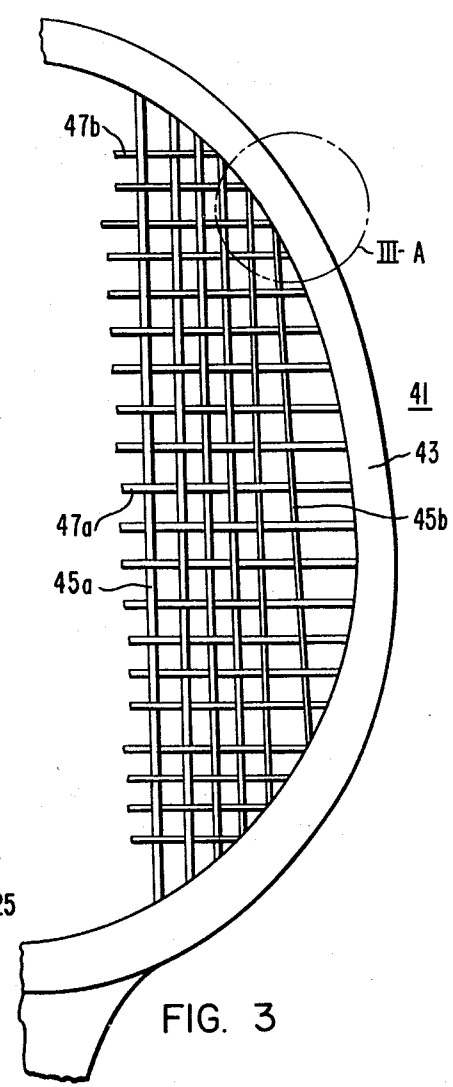
FIG. 3 is a fragmental view in front elevation showing a racquet in accordance with this invention formed with separate string of different cross-sectional area.
Figure 3A:
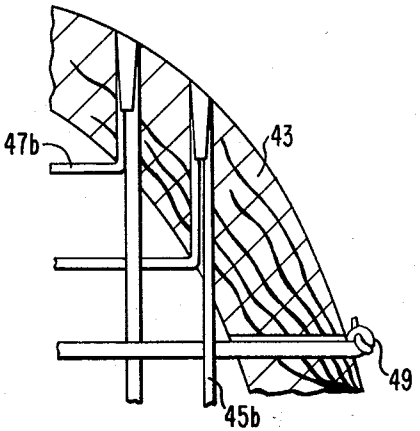
FIG. 3A is a fragmental view in section enlarged of the portion of the racquet shown in Circle IIIA of FIG. 3.

The apparatus shown in FIG. 3 is a racquet 41 including a frame 43 provided with conventional holes. This racquet 41 is strung with string lengths 45*a* and 45*b* and 47*a* and 47*b* of different cross-sectional area. The string lengths 45*a* and 47*a* near the center of the racquet are of greater cross-sectional area and the string lengths 45*b* and 47*b* near the periphery of the racquet 41 are of smaller cross-sectional area. The cross-sectional area for each of the string lengths 45*a* and 45*b* and 47*a* and 47*b* may decrease progressively from the center portion of the racquet to the periphery portion. Each of the string lengths 45*a*, 45*b*, 47*a* and 47*b* is threaded and held in the same way as the string lengths of racquet shown in FIG. 1. The trailing end of each string length has a knot which prevent it from being pulled through the trailing hole. The leading end of each string length 45*a* through 47*b* is threaded through the leading hole tensioned and locked in the hole by a tapered plug. Where a hole accommodates the ends of two string lengths, the end of the first string length to be threaded is held by a clamp similar to the clamp 29 of FIG. 2. The tension for all string lengths 45*a* through 47*b* may be the same or it may vary. The tension and cross-sectional areas are set so that the deflection of the strings throughout the face of the racquet for like impulses is substantially the same.

EXAMPLE

Computer analyses were performed to determine optimum tensions for each string segment in a racquet for three radically different racquets—wood, steel and graphite composite. The analyses showed string tensions as low as 26 pounds and as high as 82 pounds. The results for a graphite composite racquet are presented in Table I below:

TABLE I

STRING TENSIONS REQUIRED TO MAXIMIZE "SWEET SPOT"

| Longitudinal Strings (Tension in pounds) | | Transverse Strings (Tension in pounds) | |
|---|---|---|---|
| Left | 42 | Remote from Handle | 38 |
| | 46 | | 43 |
| | 49 | | 47 |
| | 52 | | 50 |
| | 54 | | 53 |
| | 56 | | 56 |
| | 58 | | 58 |
| to | 59 | to | 60 |
| | 60 | | 62 |
| | 60 | | 60 |
| | 59 | | 58 |
| | 58 | | 58 |
| | 56 | | 53 |
| | 54 | | 50 |
| | 52 | | 47 |
| | 49 | | 43 |
| | 46 | Handle | 48 |
| Right | 42 | | |

Four racquets 11 as shown in FIG. 1 of the improved stringing in accordance with this invention were strung and subjected to field comparison tests. Of the four racquets, two had a wood frame, one a steel frame, and one a graphite composite frame. One wood frame was strung with gut and one with NYLON string; the steel frame was strung with NYLON string and the graphite composite with gut. The tension in the strings was as shown in Table I, but varied somewhat. The four racquets were compared with four like racquets with conventional stringing.

The field test was performed by 16 tennis players (4 teaching professionals, 10 top amateurs, and 2 average players). The players were asked to evaluate the two racquets with regard to the size of the "sweet spot" and behavior of off-center hits without any knowledge of what racquet had the improved string and which racquet had the conventional stringing. The results are presented in Table II below:

TABLE II

FIELD TEST RESULTS

| Racquets | Conventional Stringing | Improved Stringing | No Difference |
|---|---|---|---|
| #1 Wilson Kramer Wood (strung with beef gut) | 1 | 12 | 3 |
| #2 Wilson T2000 steel (strung with nylon strings) | 0 | 11 | 5 |
| #3 Yamaha graphite composite (strung with beef gut) | 3 | 11 | 2 |
| #4 Wilson Kramer Wood (strung with nylon strings) | 0 | 14 | 2 |

While preferred embodiments of this invention have been disclosed herein, many modifications thereof are feasible. This invention is not to be restricted except insofar as is necessitated by the spirit of the prior art.

I claim:

1. A racquet for tennis, squash, racquet ball or the like, where, in play, the racquet strikes a ball, said racquet including a frame having holes and also including string threaded through said holes, said string being made up of separate short string lengths, each said string length having predetermined selectable properties or structure, each said string length threaded through a plurality of holes and each string length being subject to a predetermined tension, coordinated with its properties or structure, the coordination of said properties or structure of said string lengths being such that the deflection of a length produced by the impact of a ball around the periphery of the racquet is substantially equal to the deflection produced by a like impact of said ball near the center of said racquet, and means for securing each said string length in at least a pair of said holes through which it is threaded, so that the tension of said length is maintained under repeated impacts of said ball.

2. The racquet of claim 1 wherein the lengths of string around the periphery of the racquet are of smaller cross-sectional area than the lengths near the center of the racquet so that the deflection, produced by impact of a ball, in the string around the periphery of the racquet is substantially equal as the deflection produced by like impact of a ball in the string near the center of the racquet.

3. The racquet of claim 1 wherein the string is composed of polyamide and certain of the lengths of string are irradiated with elementary particles so that the deflection, produced by impact of a ball, in the string around the periphery of the racquet is substantially equal to the deflection produced by like impact of a ball in the string near the center of the racquet.

4. The racquet of claim 1 wherein the string is composed of polyamide and certain of the lengths of string are irradiated with elementary particles so that the modulus of elasticity of the string lengths around the periphery of the racquet is less than the modulus of the string lengths near the center of the racquet.

5. The racquet of claim 1 wherein the string is composed of materials of different modulus of elasticity, the string lengths around the periphery having a lower modulus of elasticity than the string lengths near the center.

6. A racquet for tennis, squash, racquet ball or the like, where, in play, the racquet strikes a ball, said racquet including a frame having holes and also including string threaded through said holes and secured therein, said string being made up of short separate string lengths, all of said string lengths being of the same composition and cross section, the string lengths which are strung near the periphery of the racquet being subject to lower tension than the string lengths strung near the center of the racquet, said lower and higher tensions being so related that the deflection produced by impact of said ball on the strings near the periphery of the racquet is substantially equal to the deflection produced by like impact of said ball near the center of said racquet, whereby the "sweet spot" of said racquet is maximized.

7. The racquet of claim 6 wherein the string lengths as tensioned are separately secured so that they maintained their tension separately.

8. A racquet for tennis, squash, racquet ball or the like, where, in play, the racquet strikes a ball, said racquet including a frame having holes and also including string threaded through said holes, said string being made up of short string lengths, said string length being all of the same composition and cross section, each said string length being threaded through a plurality of holes and each string length being subject to a predetermined tension, the string lengths near the periphery of the racquet being subject to lower tension than the string lengths near the center of the racquet, such that the deflection of a string length produced by impact of a ball near the periphery of the racquet is substantially equal to the deflection of a string length produced by a like impact of a ball near the center of said racquet, and means for securing each said string length in at least a pair of said holes through which it is threaded, so that the tension of said string length is maintained under repeated impacts of said ball.

9. The racquet of claim 8 wherein the string lengths between the center of the racquet and the periphery of the racquet are subject to progressively lower tension.

* * * * *